US007228079B2

(12) United States Patent
Brown et al.

(10) Patent No.: US 7,228,079 B2
(45) Date of Patent: Jun. 5, 2007

(54) METHOD AND APPARATUS FOR DETECTING A MEDIA JAM

(75) Inventors: Kim Brown, Boise, ID (US); Brian L. Watts, Boise, ID (US); Carlos F. Becerra, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 277 days.

(21) Appl. No.: 10/910,015

(22) Filed: Aug. 3, 2004

(65) Prior Publication Data

US 2006/0029401 A1 Feb. 9, 2006

(51) Int. Cl.
*G03G 15/00* (2006.01)

(52) U.S. Cl. ..... 399/21; 399/18

(58) Field of Classification Search ..... 399/16–21
See application file for complete search history.

(56) References Cited

U.S. PATENT DOCUMENTS 4,973,041 A 11/1990 Yamasaki
5,034,780 A * 7/1991 Kotabe et al. ..... 399/21
5,322,274 A 6/1994 Takahashi et al.
5,328,168 A * 7/1994 Fox ..... 271/259
5,374,045 A 12/1994 Milillo
5,678,138 A 10/1997 Kobayashi et al.
5,704,609 A 1/1998 Mandel et al.
5,963,754 A 10/1999 Itoh et al.
6,010,127 A 1/2000 DiCesare et al.
6,170,821 B1 1/2001 Kubota
6,279,899 B1 8/2001 Coffey et al.
6,560,415 B2 * 5/2003 Hirako et al. ..... 399/18
6,757,501 B2 * 6/2004 Mochizuki et al. ..... 399/18
2003/0102624 A1 6/2003 Stoll
2003/0190169 A1 * 10/2003 Shibaki ..... 399/21

* cited by examiner

*Primary Examiner*—Minh Chau
(74) *Attorney, Agent, or Firm*—James R McDaniel

(57) ABSTRACT

This invention relates to methods for determining if a media jam has been detected by a print engine, an input device, or an output device.

9 Claims, 9 Drawing Sheets

METHOD AND APPARATUS FOR DETECTING A MEDIA JAM

BACKGROUND OF THE INVENTION

1. Field of the Invention

This invention relates to methods for determining if a media jam has been detected by a print engine, an input device, or an output device.

2. Description of the Related Art

Prior to the present invention, as set forth in general terms above and more specifically below, it is known, in the media handling art that after a media jam occurs, the printer firmware performs an urgent stop to stop all media movement. However, this will leave media in the print engine and the input/output devices of the printer. Some of this media can be flushed and some cannot. Consequently, the media that cannot be flushed, which can be located under the fuser of the printer, will create additional follow-on media jams that will have to be cleared by the user.

It is also known, in the media handling art, to employ a variety of internal purges for media jam clearance. Typically, these devices utilize buckle chambers or other internal devices located within the printer in order to compile the media located upstream of the media jam. While these devices prevent further media from being jammed, these devices may wrinkle or otherwise destroy the media as it is held within the internal device. This could be especially critical if the media is expensive. Also, these internal devices are not interchangeable between various printing devices.

Finally, it is known, in the media handling art, that once a media jam has occurred, the printing engine and/or output device are stopped in order that the user can remove the jammed media. This stoppage of the printing engine and/or output device becomes an inconvenience to the user because the user must now wait for the printing engine and/or output device to warm back up before the print job can be completed.

It is apparent from the above that there exists a need in the art for a time efficient, interchangeable apparatus and method that is capable of detecting a media jam and flushing the media without damaging it. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a method for determining if a media jam has been detected by a print engine, comprising the steps of: determining if a print engine has detected a media jam; sending instructions from a media handling controller to an input device to stop the media at an outlet port of the input device; determined if the input device has picked a sheet of media; and stopping the input device and instructing the media handler controller that the input device has a sheet of media to flush.

In certain preferred embodiments, methods are also provided for determining if a media jam has been detected by an output device and flushing the media from the output device.

In another further preferred embodiment, a method is also provided for determining if a media jam has been detected by an input device.

The preferred apparatus and method for media jam detection/flushing, according to various embodiments of the present invention, offer the following advantages: ease of media flushing; excellent media jam removal characteristics from the external output device; good stability; durability; reduced downtime; and excellent economy. In fact, in many of the preferred embodiments, these factors of ease of media flushing, excellent media jam removal characteristics, and reduced downtime are optimized to an extent that is considerably higher than heretofore achieved in prior, known media jam detection/flushing techniques.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
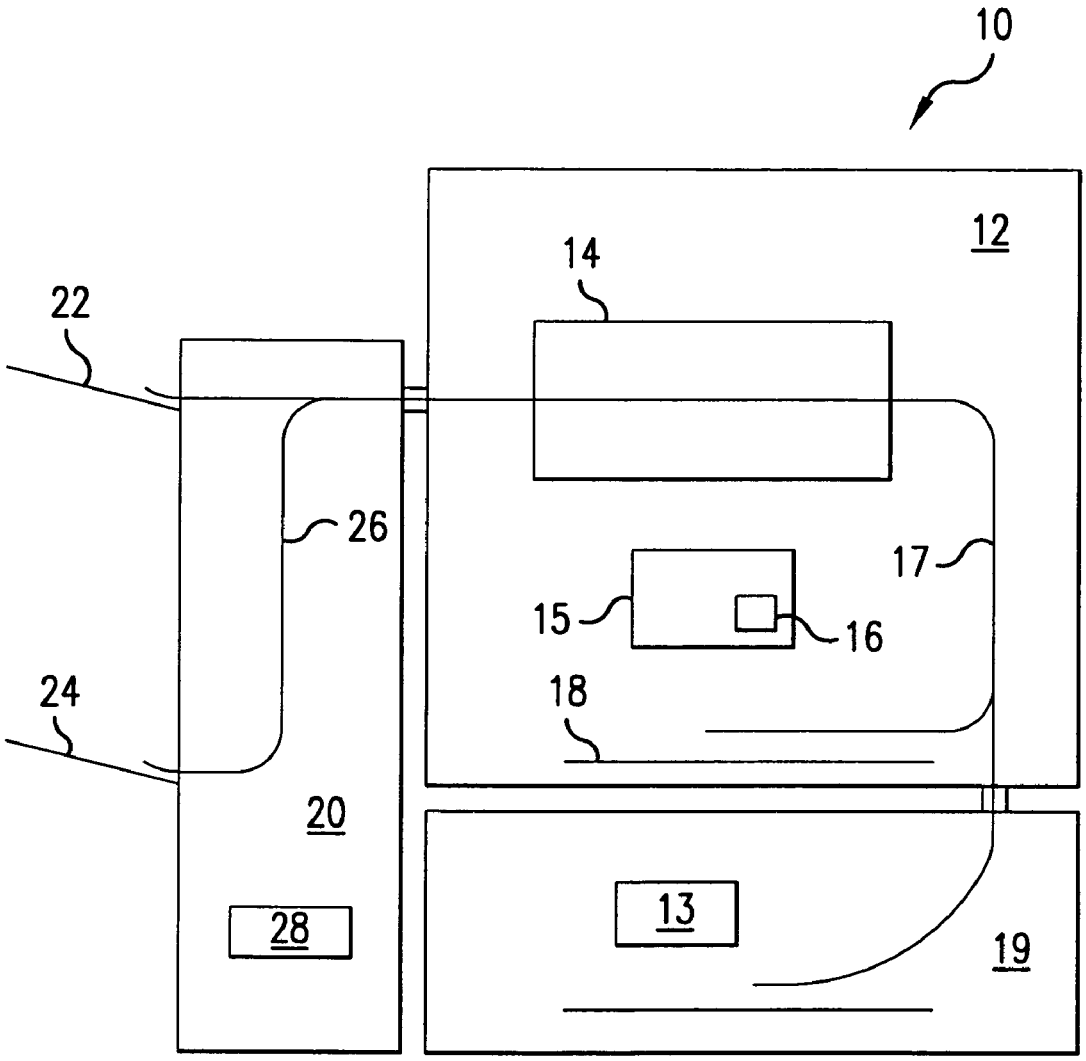
FIG. 1 is a schematic illustration of a system for flushing media after a media jam has been detected, according to one embodiment of the present invention.

With reference first to FIG. 1, there is illustrated one preferred embodiment for use of the concepts of this invention. FIG. 1 details apparatus 10 for detecting a media jam and flushing the media after the jam. Apparatus 10, includes in part, printer 12, external input device processor 13, print engine 14, formatter 15, printer processor/media handler controller 16, media transport paths 17, internal media tray 18, external input device 19, external output device 20, external output bins 22, 24, external output media transport path 26, and external output device processor 28.

With respect to the present invention, media is to be understood to be any suitable paper, plastic or other similar material upon which text and/or images can be printed. External input device processor 13, typically, has computer-usable storage media containing computer readable-instructions for causing the respective external input device to perform various operations. In some embodiments, the computer-usable storage media includes a hard drive or other computer-usable storage media that can be fixedly or removably attached to the respective external input device, e.g., magnetic media, optical media, read-only memory (ROM), electrically erasable programmable read-only memory (EEPROM), or other non-volatile storage media. Printer processor/media handler controller 16, typically, has computer-usable storage media containing computer readable-instructions for causing the respective printer to perform various operations. In some embodiments, the computer-usable storage media includes a hard drive or other computer-usable storage media that can be fixedly or removably attached to the respective imaging device, e.g., magnetic media, optical media, read-only memory (ROM), electrically erasable programmable read-only memory (EEPROM), or other non-volatile storage media. Media transport paths 17, typically, are utilized to transport the media between the printer 12, external input device 19, and external output device 20. Internal media tray 18, typically, contains media that can be printed on by print engine 14. External input device 19, typically, contains media that can be transferred to print engine 14 along one of the media transport paths 17 for subsequent printing by print engine 14. External output device 20, typically, is utilized to further process the printed media. For example, the printed media maybe collated and stapled by external output device 20. It is to be understood that a plurality of external output devices can be located adjacent to each other. External output bins 22, 24, typically, are used to hold the printed media after it has been processed by the external output device 20. It is to be understood that a plurality of external output bins can be utilized. Also, print engine 14, input device 19 and output device 20 are conventionally equipped with input and output sections which are not shown for convenience. Finally, external output device processor 28, typically, has computer-usable storage media containing computer readable-instructions for causing the respective external output device to perform various operations. In some embodiments, the computer-usable storage media includes a hard drive or other computer-usable storage media that can be fixedly or removably attached to the respective external output device, e.g., magnetic media, optical media, read-only memory (ROM), electrically erasable programmable read-only memory (EEPROM), or other non-volatile storage media.

A variety of methods will now be discussed with respect to detecting a media jam and flushing the media after the media jam. The methods will be grouped according to where the media jam occurred.

Input Device Media Jam

Figure 2:
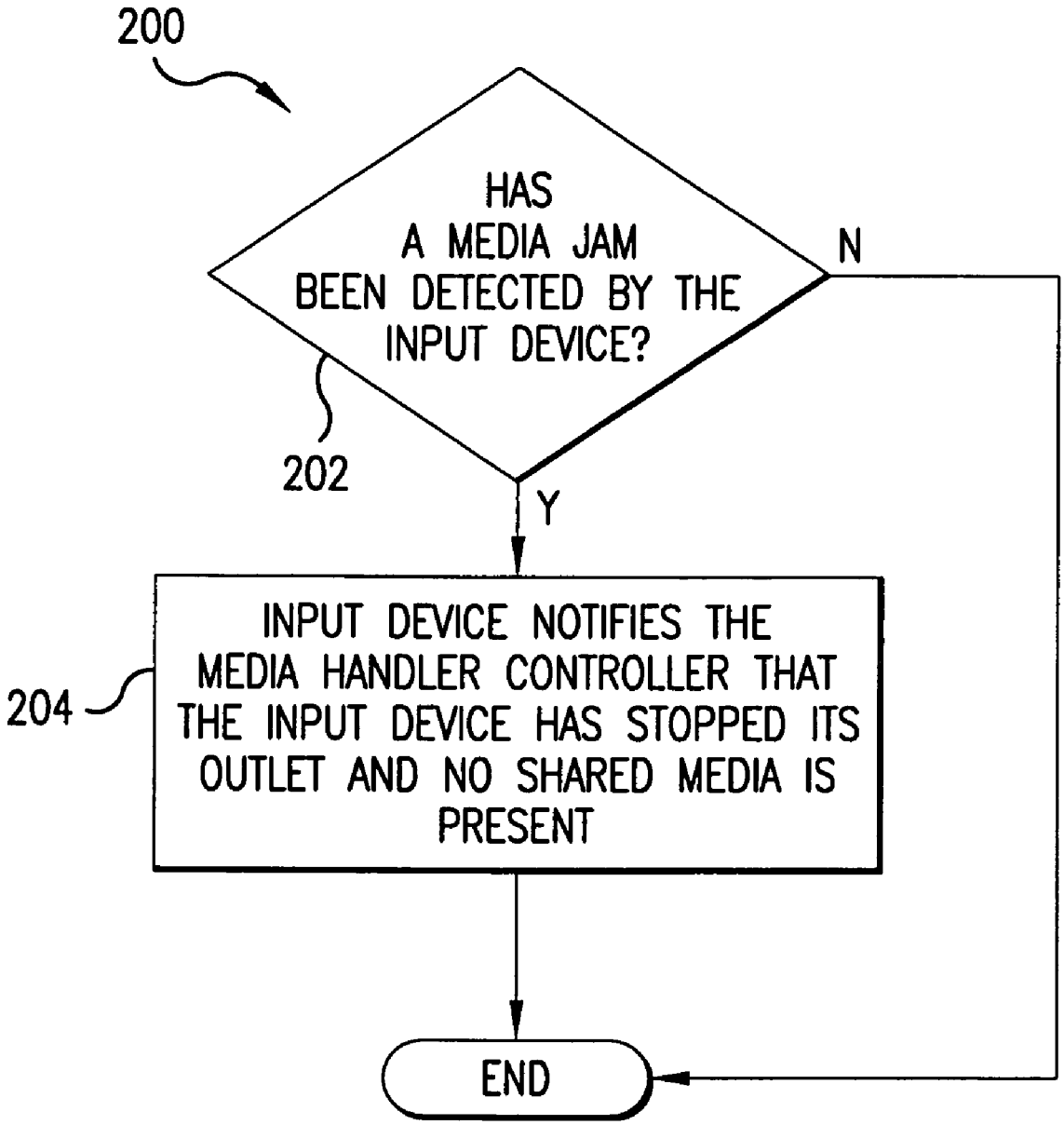
FIG. 2 is a flow diagram of a method for determining if a media jam has been detected by an input device, according to one embodiment of the present invention.

FIG. 2 illustrates a method 200 for determining if a media jam has been detected by an input device. Method 200 includes, in part, the step of determining if a media jam has been detected by the input device 19 (FIG. 1) (step 202). If a media jam has been detected by the input device, the input device 19 notifies the media handler controller 16 that the input device 19 has stopped its outlet and no shared media is present (step 204). It is to be understood that the input device can be, but is not limited to, internal tray 18 and/or external input device 19. It is also to be understood that apparatus 10 can include a display (not shown) that provides information regarding the media jams and the media flushing to the user.

Print Engine Media Jam

Figure 3:
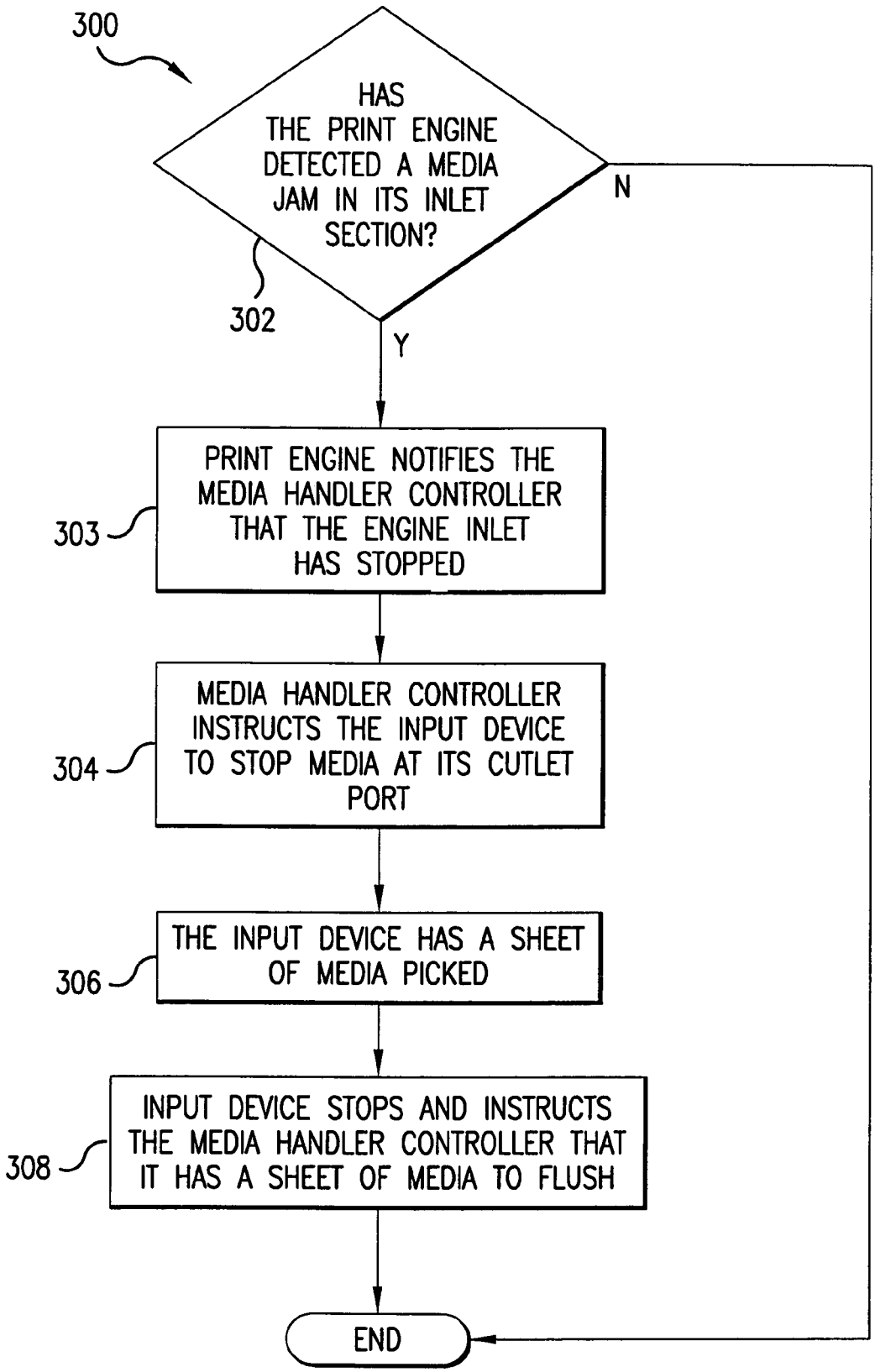
FIG. 3 is a flow diagram of a method for determining if a media jam has been detected by a print engine, according to one embodiment of the present invention.

FIG. 3 illustrates a method 300 for determining if a media jam has been detected by a print engine. Method 300 includes, in part, the step of determining if the print engine 14 (FIG. 1) has detected a media jam in its inlet section and the engine outlet section continues to move media (step 302). If a media jam has been detected by the print engine 14, the print engine 14 notifies the media handier controller 16 that the engine inlet has stopped (step 303). The media handler controller 16 then instructs the input device to stop the media at the outlet port (not shown) of the input device (step 304). It is then determined if the input device has picked a sheet of media (step 306). Finally, the input device stops and instructs the media handler controller 16 that it has a sheet of media to flush (step 308).

Figure 4:
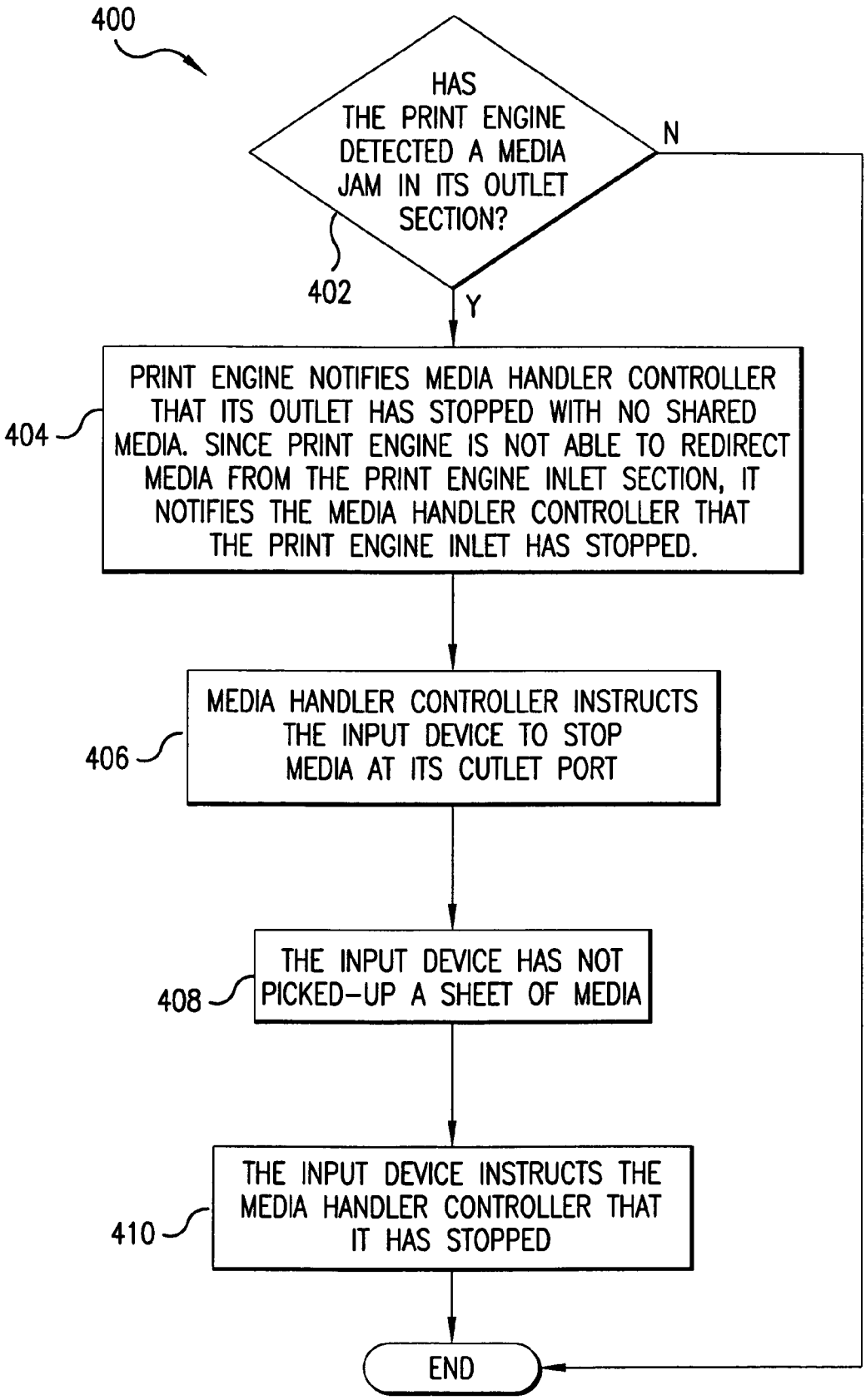
FIG. 4 is a flow diagram of another method for determining if a media jam has been detected by a print engine, according to another embodiment of the present invention.

FIG. 4 illustrates another method 400 for determining if a media jam has been detected by a print engine. Method 400 includes, in part, the step of determining if the print engine 14 (FIG. 1) has detected a media jam in its outlet section (step 402). If a media jam has been detected at the print engine 14, the print engine 14 notifies the media handler controller 16 that the print engine outlet has stopped with no shared media. Since the print engine 14 is not able to re-direct media from the print engine inlet section, it notifies the media handler controller 16 that the print engine inlet has stopped (step 404). The media handler controller 16 then instructs the input device to stop media at the outlet port of the input device (step 406). It is then determined if the input device has picked up a sheet of media (step 408). Finally, if the input device has not picked a sheet of media, the input device instructs the media handler controller 16 that the input device has stopped (step 410).

Figure 5:
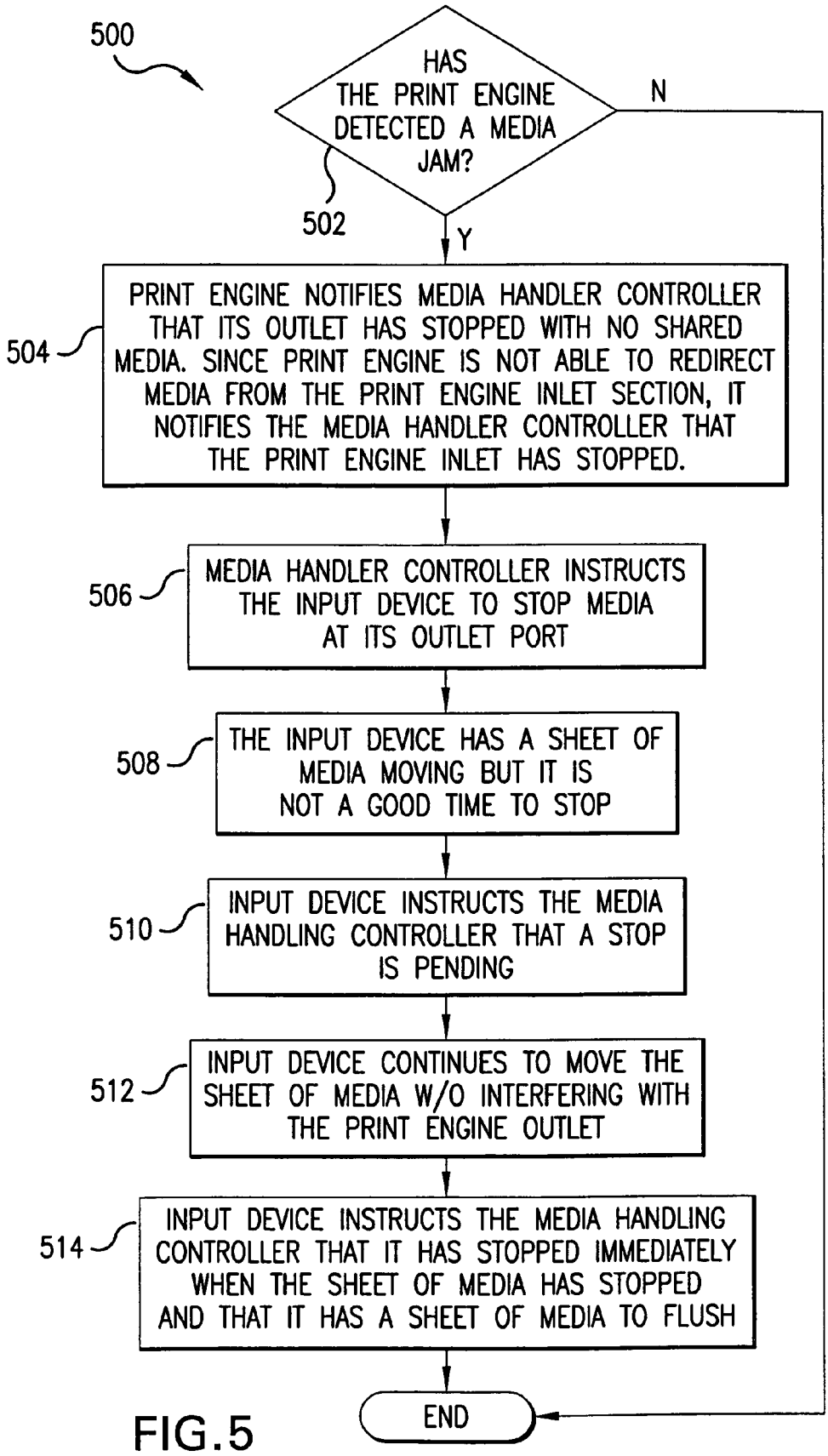
FIG. 5 is a flow diagram of another method for determining if a media jam has been detected by a print engine, according to still another embodiment of the present invention.

FIG. 5 illustrates still another method 500 for determining if a media jam has been detected by a print engine in its outlet section. Method of 500 includes, in part, the step of determining if the print engine 14 (FIG. 1) has detected a media jam (step 502). If the print engine 14 has detected a media jam, the print engine 14 notifies the media handler controller 16 that the print engine outlet has stopped with no shared media. Since the print engine 14 is not able to re-direct media from the print engine inlet section, it notifies the media handler controller 16 that the print engine inlet has stopped (step 504). The media handler controller 16 instructs the input device to stop media at the output port of the input device (step 506). It is then determined if the input device has a sheet of media moving, but it is not a good time for the input device to stop the movement of the sheet of media (step 508). The input device then instructs the media handling controller 16 that a stoppage of the input device is pending (step 510). The input device continues to move the sheet of media without interference with the inlet of the print engine 14 (step 512). Finally, the input device instructs the media handling controller 16 that the input device has stopped immediately when the sheet of media has stopped and that the input device has a sheet of media to flush (step 514).

Output Device Media Jam

Figure 6:
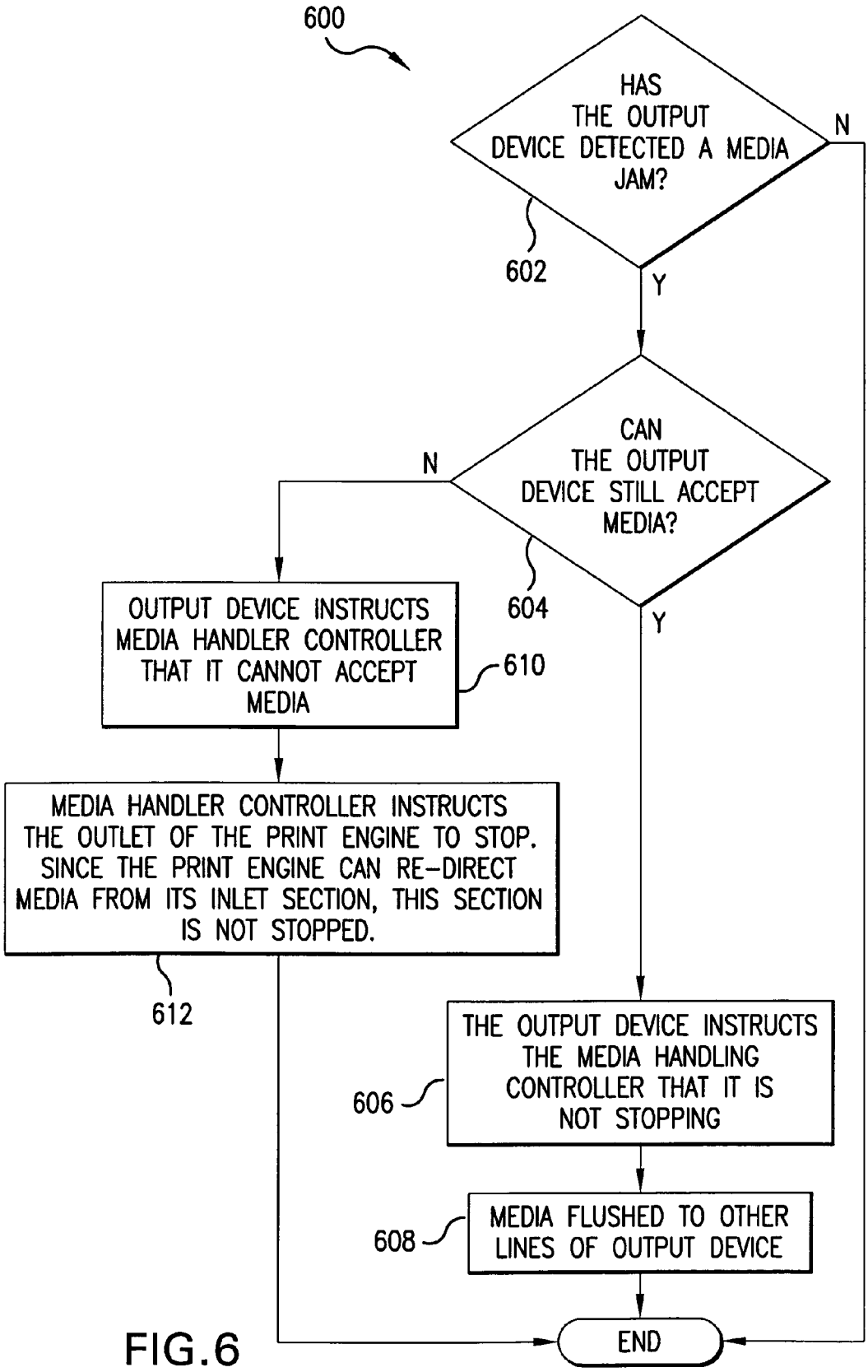
FIG. 6 is a flow diagram of a method for determining if a media jam has been detected by an output device, according to one embodiment of the present invention.

FIG. 6 illustrates a method 600 for determining if a media jam has been detected at one of the external output bins 22,24 (FIG. 1) by an output device 20. Method 600 includes, in part, the step of determining if the external output device 20 has detected a media jam (step 602). It is then determined whether or not the output device 20 can still accept media (step 604). If the output device 20 can still accept media, then the output device 20 instructs the media handling controller 16 that the output device 20 is not stopping (step 606). After this, the media is flushed to the other, un-jammed bin of the output device 20 (step 608). If the output device 20 cannot accept media, output device 20 instructs media handler controller 16 that it cannot accept further media (step 610). Finally, media handler controller 16 instructs the outlet of the print engine 14 to stop. Since the print engine 14 can re-direct media from its inlet section, this section is not stopped (step 612).

Figure 7:
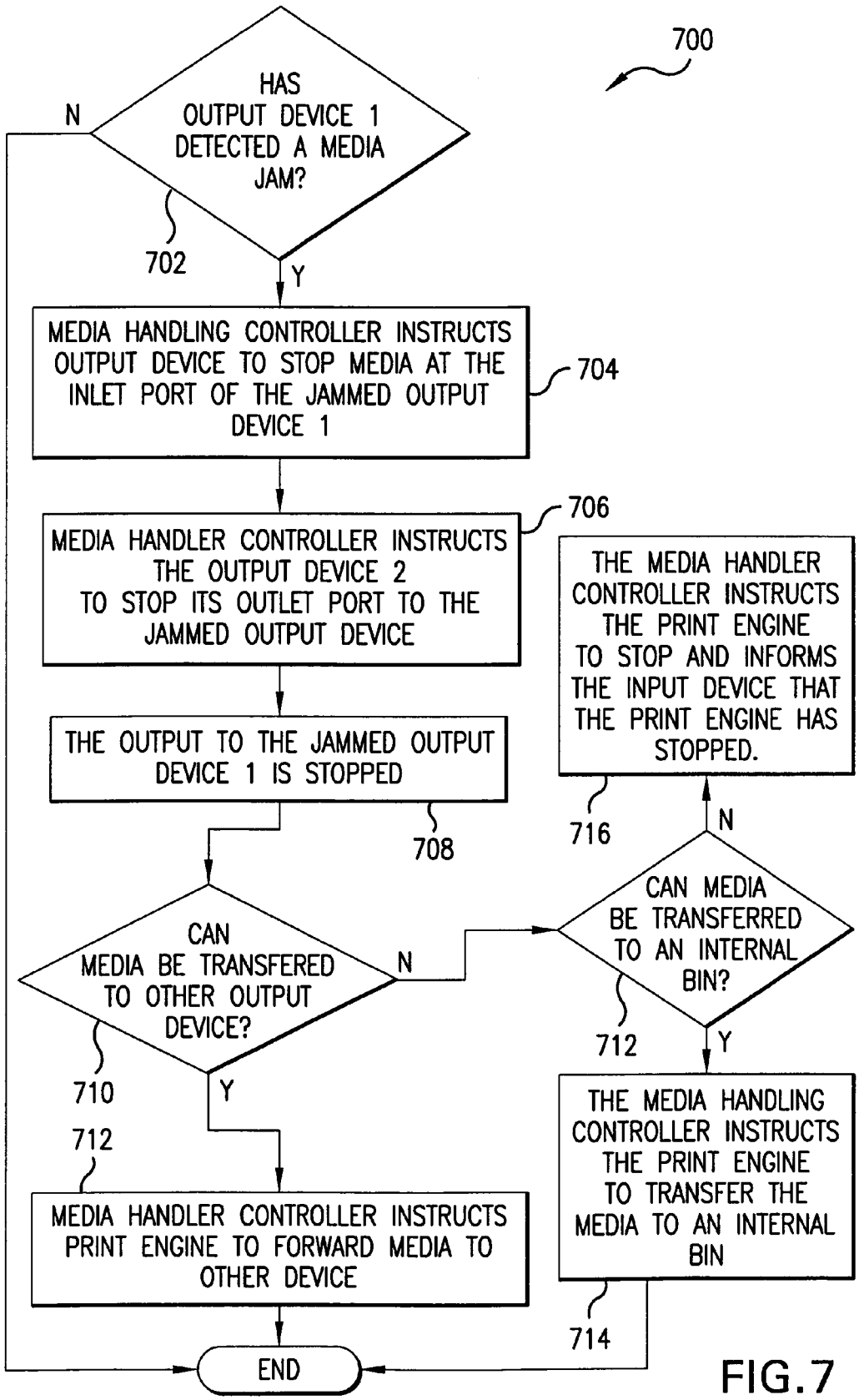
FIG. 7 is a flow diagram of another method for determining if a media jam has been detected by at least one output device, according to another embodiment of the present invention.

FIG. 7 illustrates another method 700 for determining if a media jam has been detected by at least one output device 20. Method 700 includes, in part, the step of determining if an output device 20 has detected a media jam (step 702). If a media jam has been detected by an output device 20, media handling controller 16 instructs jammed output device 20 to stop media at the inlet port (not shown) of the jammed output device 20 (step 704). Media handling controller 16 then instructs another output device 20 to stop its outlet port to the jammed output device 20 (step 706). The output to the jammed output device 20 is then stopped (step 708). It is then determined if the media can be transferred to the other, un-jammed output device 20 (step 710). If the media can be transferred to the un-jammed output device, media handling controller 16 instructs print engine 14 to forward media to the un-jammed output device 20 (step 718). However, if the media cannot be transferred to the other output device, it is determined if the media can be transferred to an internal bin (not shown) of the jammed output device 20 (step 712). If the media can be transferred to the internal bin 18, media handling controller 16 instructs print engine 14 to transfer the media to an internal bin (step 714). However, if the media cannot be transferred to the internal bin, the media handler controller 16 instructs the print engine 14 to stop and informs the input device 19 that the print engine 14 has stopped (step 716).

Shared Media Jam

Figure 8:
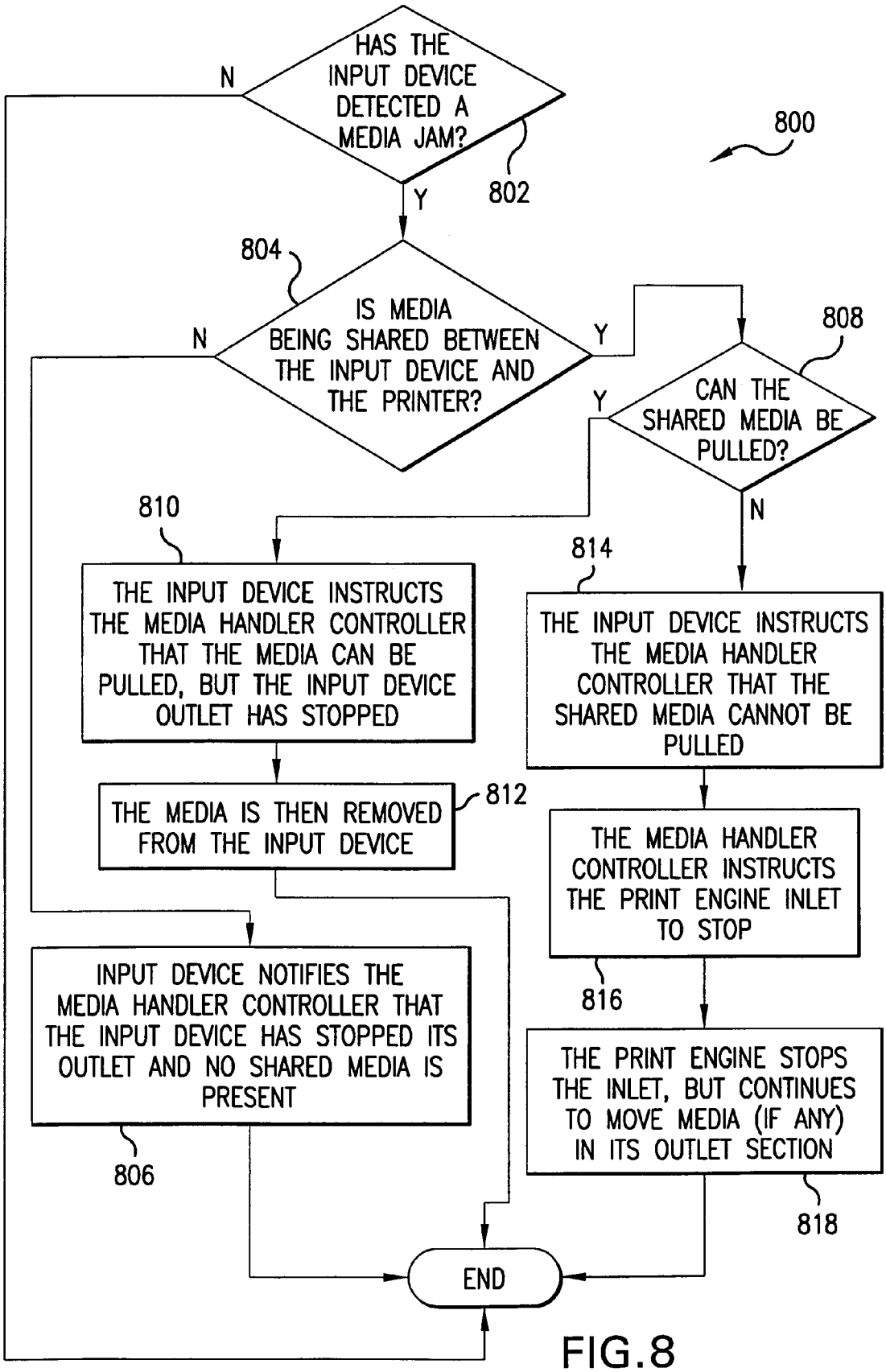
FIG. 8 is a flow diagram of a method for determining if a media jam has been detected by an input device and media is being shared, according to an embodiment of the present invention.

FIG. 8 is a flow diagram of a method 800 for determining if a media jam has been detected by an input device and media is being shared. Method 800 includes, in part, the step of determining if the input device 19 (FIG. 1) has detected a media jam (step 802). If a media jam has been detected, it is then determined if media is being shared between the input device 19 and the printer 12 (step 804). If the media is not being shared, the input device 19 notifies the media handler controller 16 that the input device 19 has stopped at its outlet (step 806). If media is being shared, it is determined if the shared media can be pulled (step 808). If the media cannot be pulled, then the input device instructs the media handler controller 16 that the shared media cannot be pulled (step 814). The media handler controller 16 instructs the print engine inlet to stop (step 816). The print engine 14 stops the inlet, but continues to move media (if any) in its outlet section (step 818). However, if the input device instructs the media handler controller 16 that the media can be pulled, but the input device outlet has stopped (step 810), the media is then removed from the input device (step 812).

Figure 9:
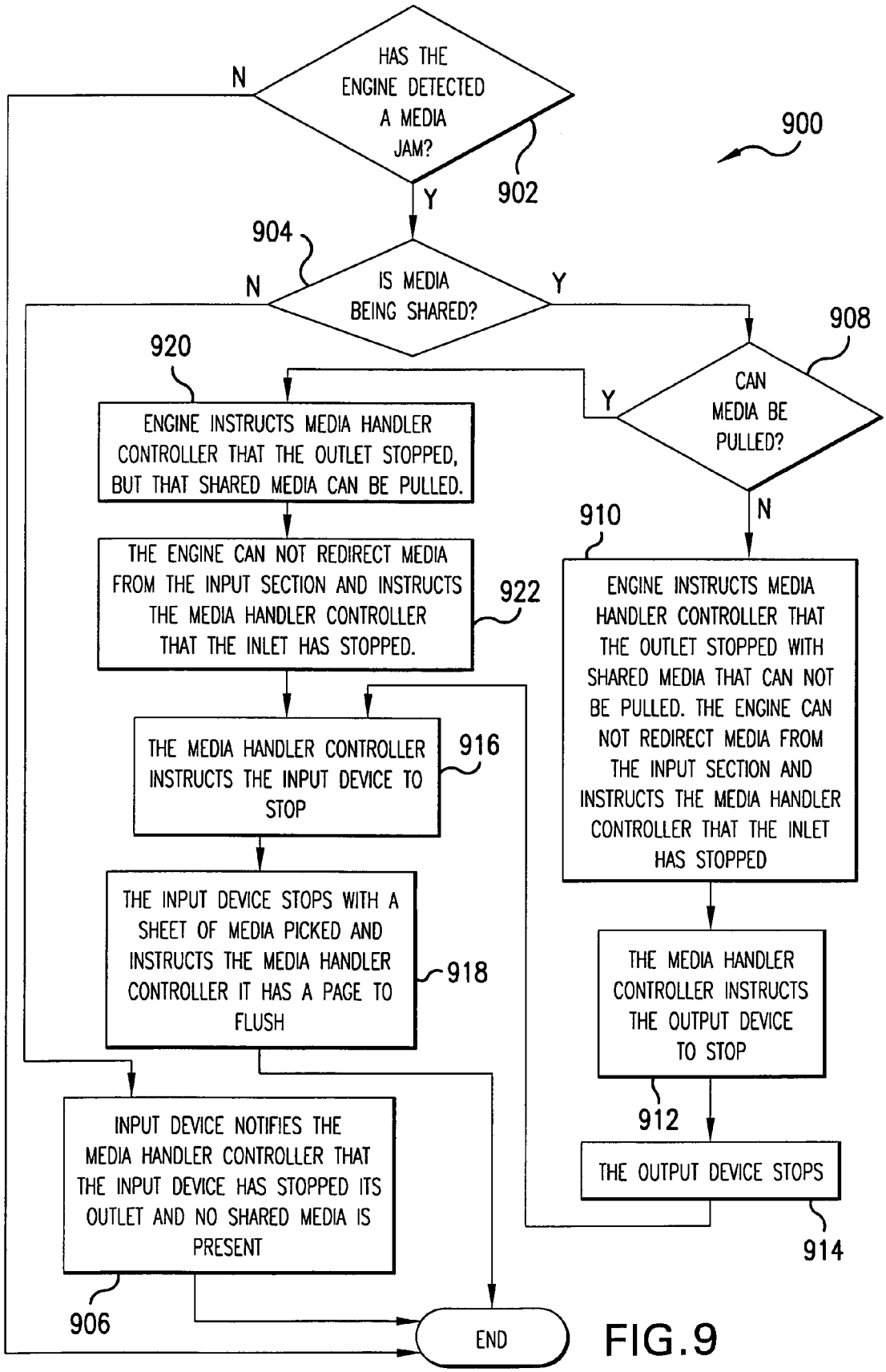
FIG. 9 is a flow diagram of a method for determining if a media jam has been detected by a print engine and media is being shared, according to an embodiment of the present invention.

FIG. 9 is a flow diagram of a method 900 for determining if a media jam has been detected by a print engine and media is being shared. Method 900 includes, in part, the step of determining if the print engine 14 has detected a media jam (step 902). If a media jam has been detected, it is then determined if media is being shared between the print engine 14 and the external output device 20 (step 904). If the media is not being shared, the print engine 14 notifies the media handler controller 16 that the print engine 14 has stopped at its outlet (step 906). If media is being shared, it is determined if the shared media can be pulled (step 908). If the media cannot be pulled, then the print engine instructs the media handler controller 16 that the shared media cannot be pulled and that the print engine 14 cannot re-direct the media from the input section. The print engine 14 instructs the media handler controller 16 that the inlet has stopped (step 910). The media handler controller 16 instructs the output device 20 to stop (step 914). The media handler controller 16 instructs the input device 19 to stop (step 916). The input device 19 stops with a sheet of media picked and instructs the media handler controller 16 that it has a sheet of media to flush (step 918). However, if the print engine 14 instructs the media handler controller 16 that the media can be pulled (step 920). However, if the print engine 14 cannot re-direct the media from the input section, the print engine 14 instructs the media handler controller 16 that the inlet has stopped (step 920).

It is to be understood that the flowcharts of FIGS. 2–9 show the architecture, functionality, and operation of one implementation of the present invention. If embodied in software, each block may represent a module, segment, or portion of code that comprises one or more executable instructions to implement the specified logical function(s). If embodied in hardware, each block may represent a circuit or a number of interconnected circuits to implement the specified logical function(s).

Also, the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Although the flowcharts of FIGS. 2–9 show a specific order of execution, the order of execution may differ from that which is depicted. For example, the order of execution of two or more blocks may be scrambled relative to the order shown. Also, two or more blocks shown in succession in FIGS. 2–9 may be executed concurrently or with partial concurrence. All such variations are within the scope of the present invention.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method for determining if a media jam has been detected by an input device and media is being shared, comprising the steps of:

determining if an input device has detected a media jam;

determining if media is being shared between the input device and another device;

having the input device notify a media handler controller that the input device has stopped its outlet and shared media is present;

determining if the shared media can be pulled; and removing the media.

2. The method, as in claim 1, wherein the method is further comprised of the steps of:

having the input device instruct the media handler controller that the shared media cannot be pulled;

having the media handler controller instruct a print engine inlet section to stop; and having a print engine stop the inlet section, but continue to move media in an outlet section of the print engine.

3. The method as in claim 1 wherein the method is further comprised of the step of:

displaying the location of the media jam to a user.

4. A program storage medium readable by a computer, tangibly embodying a program of instructions executable by the computer to perform method steps for determining if a media jam has been detected by an input device and media is being shared, comprising the steps of:

determining if an input device has detected a media jam;

determining if media is being shared between the input device and another device;

having the input device notify a media handler controller that the input device has stopped its outlet and shared media is present;

determining if the shared media can be pulled; and removing the media.

5. The method, as in claim 4, wherein the method is further comprised of the steps of:

having the input device instruct the media handler controller that the shared media cannot be pulled;

having the media handler controller instruct a print engine inlet section to stop; and having a print engine stop the inlet section, but continue to move media in an outlet section of the print engine.

6. The method as in claim 4, wherein the method is further comprised of the step of:

displaying the location of the media jam to a user.

7. A system for determining if a media jam has been detected by an input device and media is being shared, comprising:

means for determining if an input device has detected a media jam;

means for determining if media is being shared between the input device and another device;

means for having the input device notify a media handler controller that the input device has stopped its outlet and shared media is present;

means for determining if the shared media can be pulled; and means for removing the media.

8. The system, as in claim 7, wherein the system is further comprised of:

means for having the input device instruct the media handler controller that the shared media cannot be pulled;

means for having the media handler controller instruct a print engine inlet section to stop; and means for having a print engine stop the inlet section, but continue to move media in an outlet section of the print engine.

9. The system, as in claim 7, wherein the system is further comprised of:

means for displaying the location of the media jam to a user.

* * * * *

UNITED STATES PATENT AND TRADEMARK OFFICE

CERTIFICATE OF CORRECTION

PATENT NO. : 7,228,079 B2
APPLICATION NO. : 10/910015
DATED : June 5, 2007
INVENTOR(S) : Kim Brown et al.

It is certified that error appears in the above-identified patent and that said Letters Patent is hereby corrected as shown below:

In column 7, line 42, in Claim 3, delete "claim 1" and insert -- claim 1, --, therefor.

Signed and Sealed this

Nineteenth Day of August, 2008

JON W. DUDAS
*Director of the United States Patent and Trademark Office*